US008824577B2

(12) United States Patent
Shim et al.

(10) Patent No.: US 8,824,577 B2
(45) Date of Patent: Sep. 2, 2014

(54) APPARATUS AND METHOD FOR ENCODING AND DECODING MULTICHANNEL SIGNAL

(75) Inventors: Hwan Shim, Yongin-si (KR); Eun-Mi Oh, Seoul (KR); Mi-Young Kim, Hwaseong-si (KR); Anton V. Porov, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 567 days.

(21) Appl. No.: 13/088,720

(22) Filed: Apr. 18, 2011

(65) Prior Publication Data

US 2011/0255588 A1 Oct. 20, 2011

(30) Foreign Application Priority Data

Apr. 17, 2010 (KR) ..... 10-2010-0035573

(51) Int. Cl.
*H04K 1/10* (2006.01)

(52) U.S. Cl.
USPC ..... 375/260; 375/299; 375/349

(58) Field of Classification Search
USPC ..... 375/260, 299, 349
See application file for complete search history.

(56) References Cited

U.S. PATENT DOCUMENTS

| | | | | |
|---|---|---|---|---|
| 2007/0223708 | A1 | 9/2007 | Villemoes et al. | |
| 2008/0253576 | A1 * | 10/2008 | Choo et al. | 381/10 |
| 2009/0325524 | A1 * | 12/2009 | Oh et al. | 455/205 |
| 2010/0241436 | A1 * | 9/2010 | Kim et al. | 704/500 |

FOREIGN PATENT DOCUMENTS

| | | |
|---|---|---|
| KR | 10-2006-0132682 | 12/2006 |
| KR | 10-2008-0093342 | 10/2008 |
| KR | 10-2008-0107433 | 12/2008 |
| KR | 10-2009-0007471 | 1/2009 |
| KR | 10-2009-0119843 | 11/2009 |
| KR | 10-2009-0122145 | 11/2009 |

* cited by examiner

*Primary Examiner* — Kabir A Timory
(74) *Attorney, Agent, or Firm* — Staas & Halsey LLP

(57) ABSTRACT

Disclosed is an apparatus for encoding and decoding multi-channel signals. The apparatus for encoding the multi-channel signals may shift a phase of the multi-channel signals based on a characteristic of the multi-channel signals. An encoded bitstream with respect to the multi-channel signals may be generated using a downmix signal and a residual signal extracted from the phase-shifted multi-channel signals.

11 Claims, 8 Drawing Sheets

APPARATUS AND METHOD FOR ENCODING AND DECODING MULTICHANNEL SIGNAL

CROSS-REFERENCE TO RELATED APPLICATIONS

This application claims the priority benefit of Korean Patent Application No. 10-2010-0035573, filed on Apr. 17, 2010, in the Korean Intellectual Property Office, the disclosure of which is incorporated herein by reference.

BACKGROUND

1. Field

Example embodiments relate to an apparatus and method for encoding and decoding multi-channel signals.

2. Description of the Related Art

As a scheme used for encoding a stereo signal, there may be a parametric stereo technology. The parametric stereo technology may include generating a mono signal by downmixing an inputted stereo signal, extracting a stereo parameter indicating side information with respect to the stereo signal, and encoding the stereo signal by encoding the generated mono signal and the extracted stereo parameter.

The stereo parameter may include an inter-channel intensity difference (IID) or a channel level differences (CLD) indicating a intensity difference according to an energy level of at least two channel signals included in the stereo signal, an inter-channel coherence (or inter-channel correlation) (ICC) indicating a correlation between two channel signals according to a similarity of waves of at least two signals included in the stereo signal, an inter-channel phase difference (IPD) indicating a phase difference between at least two channel signals included in the stereo signal, and an overall phase difference (OPD) indicating distribution of a phase difference between two channels based on a mono signal, and the like, where the phase difference is between at least two signals included in the stereo signal.

SUMMARY

The foregoing and/or other aspects are achieved by providing an encoding apparatus including a parameter extractor to extract, from multi-channel signals, a plurality of parameters indicating a characteristic relationship between a plurality of channels constituting the multi-channel signals, a phase shifter to shift a phase of the multi-channel signals using a phase angle that is calculated for each of the plurality of parameters and the plurality of channels, a signal extractor to extract, from the phase-shifted multi-channel signals and using the plurality of parameters, a downmix signal and a residual signal, and a bitstream generator to generate a bitstream by encoding the downmix signal, the residual signal, and the plurality of parameters.

The example embodiments may include a phase shifter that may shift the phase of the multi-channel signals so that each multi-channel signal may have the same phase.

The example embodiments may also include a phase shifter that may shift the phase of the multi-channel signals by a predetermined amount so that phase difference information between the channels may have a value less than or equal to a value of a predetermined angle.

The example embodiments may also include a phase shifter that may shift the phase of the multi-channel signals so that a change in the phase angle may be minimized.

The foregoing and/or other aspects are achieved by providing an encoding apparatus including a parameter extractor to extract, from multi-channel signals, a plurality of parameters indicating a characteristic relationship between a plurality of channels constituting the multi-channel signals, a magnitude changing unit to change a magnitude of the multi-channel signals, using the plurality of parameters, a signal extractor to extract, from the magnitude-changed multi-channel signals and using the plurality of parameters, a downmix signal and a residual signal, and a bitstream generator to generate a bitstream by encoding the downmix signal, the residual signal, and the plurality of parameters.

The foregoing and/or other aspects are achieved by providing a decoding apparatus including a decoding unit to restore a downmix signal and a residual signal of multi-channel signals, and a plurality of parameters indicating a characteristic relationship between a plurality of channels constituting the multi-channel signals, an upmixing unit to upmix the downmix signal and the residual signal into the multi-channel signals, using the restored parameters, and a restoring unit to restore at least one of a phase and a magnitude of the multi-channel signals upmixed using the restored parameters.

The foregoing and/or other aspects are achieved by providing an encoding method for encoding multi-channel signals in an encoding apparatus, the method including extracting, by a parameter extractor of the encoding apparatus, from multi-channel signals, a plurality of parameters indicating a characteristic relationship between a plurality of channels constituting the multi-channel signals, shifting, by a phase shifter of the encoding apparatus, a phase of the multi-channel signals, using a phase angle that is calculated for each of the plurality of parameters and the plurality of channels, extracting, by a signal extractor of the encoding apparatus, from the phase-shifted multi-channel signals and using the plurality of parameters, a downmix signal and a residual signal, and generating, by a bitstream generator of the encoding apparatus, a bitstream by encoding the downmix signal, the residual signal, and the plurality of parameters.

The foregoing and/or other aspects are achieved by providing an encoding method for encoding multi-channel signals in an encoding apparatus, the method including extracting, by a parameter extractor of the encoding apparatus, from multi-channel signals, a plurality of parameters indicating a characteristic relationship between a plurality of channels constituting the multi-channel signals, changing, by a magnitude changing unit of the encoding apparatus, a magnitude of the multi-channel signals, using the plurality of parameters, extracting, by a signal extractor of the encoding apparatus, from the magnitude-changed multi-channel signals and using the plurality of parameters, a downmix signal and a residual signal, and generating, by a bitstream generator of the encoding apparatus, a bitstream by encoding the downmix signal, the residual signal, and the plurality of parameters.

The foregoing and/or other aspects are achieved by providing a decoding method for decoding multi-channel signals in a decoding apparatus, the method including restoring, by a decoding unit of the decoding apparatus, a downmix signal and a residual signal of multi-channel signals, and a plurality of parameters indicating a characteristic relationship between a plurality of channels constituting the multi-channel signals, upmixing, by an upmixing unit of the decoding apparatus, the downmix signal and the residual signal into the multi-channel signals, using the restored parameters, and restoring, by a restoring unit of the decoding apparatus, at least one of a phase and a magnitude of the multi-channel signals upmixed using the restored parameters.

Additional aspects of embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
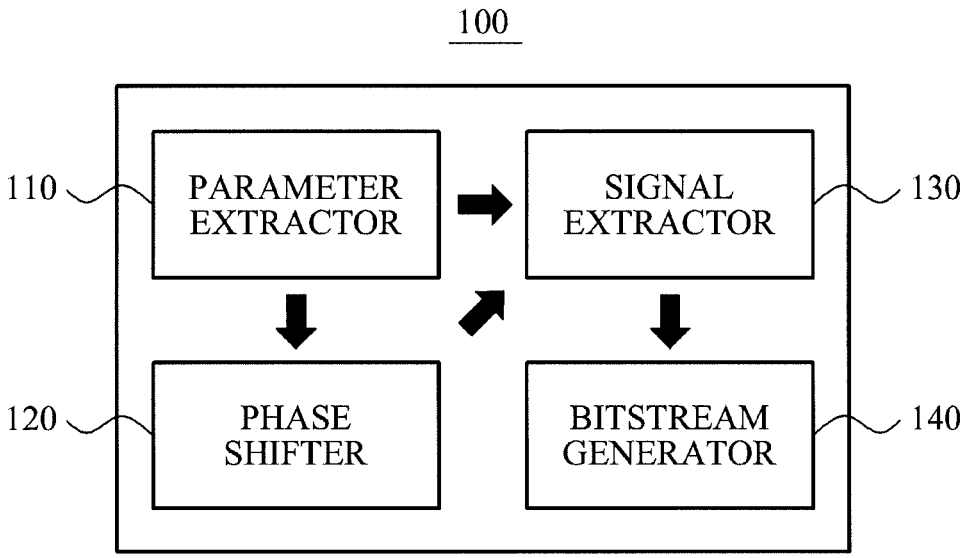
FIG. 1 illustrates a block diagram describing an internal configuration of an encoding apparatus according to example embodiments.

Reference will now be made in detail to embodiments, examples of which are illustrated in the accompanying drawings, wherein like reference numerals refer to the like elements throughout. Embodiments are described below to explain the present disclosure by referring to the figures.

FIG. 1 illustrates a block diagram describing an internal configuration of an encoding apparatus 100 according to example embodiments. Referring to FIG. 1, to encode multi-channel signals, the encoding apparatus 100, which may be a computer, according to example embodiments may include a parameter extractor 110, a phase shifter 120, a signal extractor 130, and a bitstream generator 140. Hereinafter, functions for each component will be described.

Here, the multi-channel signals may refer to signals having a plurality of channels, and each of the plurality of channels included in the multi-channel signals may refer to a channel signal in the present disclosure.

The parameter extractor 110 may extract, from multi-channel signals, a plurality of parameters indicating a characteristic relationship between a plurality of channels constituting the multi-channel signals. Here, the plurality of parameters may include at least two of a channel level difference (CLD) between the plurality of channels, an inter-channel phase difference (IPD) between the plurality of channels, and an inter-channel coherence (ICC) between the plurality of channels. The parameters may include an overall phase difference (OPD) of a downmix and each channel, and a corresponding spatial parameter.

The phase shifter 120 may shift a phase of multi-channel signals using a phase angle that is calculated for each of the plurality of parameters and the plurality of channels. As an embodiment, the phase shifter 120 may shift the phase of the multi-channel signals so that each multi-channel signal may have the same phase. As another embodiment, the phase shifter 120 may shift the phase of the multi-channel signals by a predetermined amount so that a phase difference information between the channels may have a value less than or equal to a value of a predetermined angle. For example, the predetermined angle may be 90 degrees. As still another embodiment, the phase shifter 120 may shift the phase of the multi-channel signals so that a change in the phase angle may be minimized. The phase shifter 120 according to each embodiment will be further described.

The signal extractor 130 may extract, from the phase-shifted multi-channel signals and using the plurality of parameters, a downmix signal and a residual signal. The downmix signal may include a single-channel signal generated from the multi-channel signals having two or more channels. The generating of the downmix signal from the multi-channel signals having two or more channels may refer to downmixing, and an amount of bits of a bitstream generated in an encoding process may be reduced through the downmixing. The downmix signal may be a signal representing the multi-channel signals. The residual signal may be generated using information lost during a process of encoding an original source signal into the downmix signal and the plurality of parameters. By encoding the residual signal that may correspond to an error signal generated due to a parametric expression, a high quality audio may be provided using the residual signal at a high bit rate.

The bitstream generator 140 may generate the bitstream by encoding the downmix signal, the residual signal, and the plurality of parameters. The encoding apparatus 100 may encode and transmit the downmix signal and the residual signal extracted using the plurality of parameters, without encoding each of the multi-channel signals. As an example, in a case where the multi-channel signals are voice signals, the bitstream generator 140 may generate the bitstream by encoding the downmix signal and the residual signal in a code-excited linear prediction (CELP) scheme. As another example, in a case where the multi-channel signals are music signals, the bitstream generator 140 may generate the bitstream by encoding the downmix signal and the residual signal using the existing Moving Picture Experts Group (MPEG)-2/4 advanced audio coding (AAC) scheme, MPEG Audio Layer-3 (mp3) scheme, and the like. The residual signal may not be transmitted as necessary.

As another embodiment, the encoding apparatus 100 may perform both of the phase shift and the extraction of the downmix signal and the residual signal in the signal extractor 130, without additionally including the phase shifter 120. The encoding apparatus 100 according to the other embodiment may include the parameter extractor 110 to extract, from multi-channel signals, a plurality of parameters indicating a characteristic relationship between a plurality of channels constituting the multi-channel signals, the signal extractor 130 to shift a phase of the multi-channel signals using a phase angle that is calculated for each of the plurality of parameters and the plurality of channels, and to extract, from the phase-shifted multi-channel signals, a downmix signal and a residual signal, and the bitstream generator 140 to generate a bitstream by encoding the downmix signal, the residual signal, and the plurality of parameters.

Figure 2:
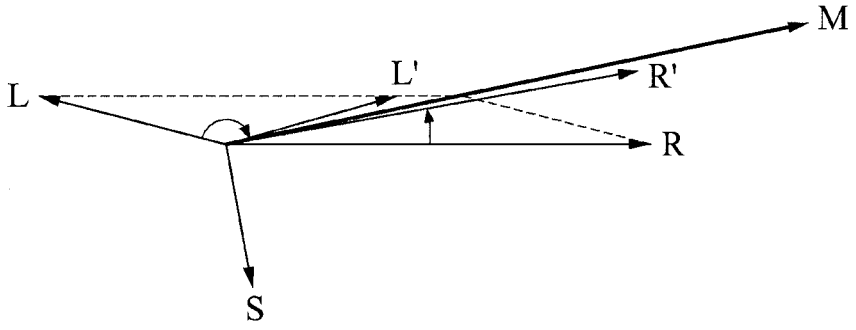
FIG. 2 illustrates a diagram describing a phase shift of multi-channel signals as stereo signals according to example embodiments.

FIG. 2 illustrates a diagram describing a phase shift of multi-channel signals as stereo signals according to example embodiments.

In FIG. 2, for convenience of description, it is assumed that multi-channel signals inputted in an encoding apparatus 100 correspond to stereo signals including a left channel signal and a right channel signal. However, it may be clear for those skilled in the art that the encoding apparatus 100 according to embodiments is not limited to the stereo signals and may be used for encoding the multi-channel signals.

Referring to FIG. 2, a relationship among a left channel signal L, a right channel signal R, a downmix signal M, and a residual signal S is described. When the stereo signals are downmixed or upmixed, in a case where the left channel signal L and the right channel signal R are out-of-phase or near out-of-phase, a magnitude of L+R may decrease, and may approach "0" depending on circumstances. To compensate for an energy loss due to the decrease, a magnitude of the downmix signal M may be generally set by multiplying a sum of the L and the R by a gain calculated to reflect a sum of energies of the L and the R. The gain may increase so as to come close to being out-of-phase or near out-of-phase, a divergence may occur according to a relationship between a plurality of extracted parameters, and a magnitude of the residual signal may increase since the obtained gain may be multiplied by the residual signal S. Accordingly, the gain may be limited. Since the limiting of gain may influence not only the downmix signal M, but also the residual signal S, the encoding apparatus 100 according to embodiments may control a gain value by shifting a phase of the stereo signal to control a value of an IPD corresponding to phase information. FIG. 2 illustrates a phase-shifted left channel signal L' obtained by shifting a phase of the left channel signal L, and a phase-shifted right channel signal R' obtained by shifting a phase of the right channel signal R. As illustrated in FIG. 2, in a case where the downmix or the upmix are performed using the phase-shifted left channel signal L' and the phase-shifted right channel signal R', the gain divergence may be prevented since the out-of-phase may not occur (the phase-shifted left channel signal L' and the phase-shifted right channel signal R' may remain in-phase). By preventing the gain divergence, a change in a value of the residual signal S according to the gain divergence may not occur, and a loss generated in the downmix may be compensated.

Figure 3:
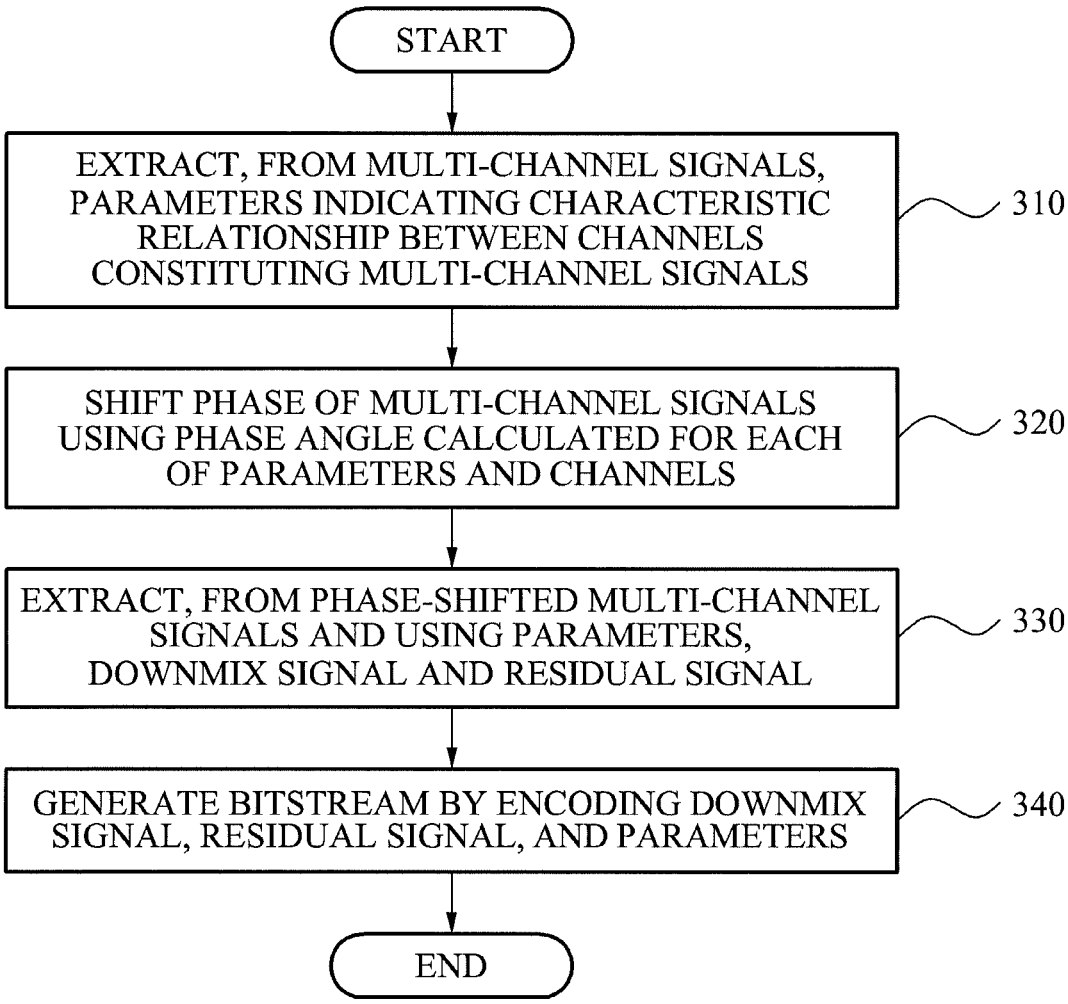
FIG. 3 illustrates a flowchart describing a scheme for encoding multi-channel signals according to example embodiments.

FIG. 3 illustrates a flowchart describing a scheme for encoding multi-channel signals according to example embodiments. The encoding scheme according to embodiments may be performed by an encoding apparatus 100 described with reference to FIG. 1. In FIG. 3, the encoding scheme may be described by describing each operation performed by the encoding apparatus 100.

In operation 310, the encoding apparatus 100 may extract, from multi-channel signals, a plurality of parameters indicating a characteristic relationship between a plurality of channels constituting the multi-channel signals. Here, the plurality of parameters include at least two of a channel level differences between the plurality of channels, an inter-channel phase difference between the plurality of channels, and an inter-channel coherence between the plurality of channels. Operation 310 may be performed by a parameter extracting unit 110 of the encoding apparatus 100.

In operation 320, the encoding apparatus 100 may shift a phase of the multi-channel signals using a phase angle that is calculated for each of the plurality of parameters and the plurality of channels. As an embodiment, the encoding apparatus 100 may shift the phase of the multi-channel signals so that each multi-channel signal may have the same phase. As another embodiment, the encoding apparatus 100 may shift the phase of the multi-channel signals by a predetermined amount so that phase difference information between the channels may have a value less than or equal to a value of a predetermined angle. For example, the predetermined angle may be 90 degrees. As still another embodiment, the encoding apparatus 100 may shift the phase of the multi-channel signals so that a change in the phase angle may be minimized. The phase shift according to each embodiment will be further described. Operation 320 may be performed by a phase shifter 120 of the encoding apparatus 100.

In operation 330, the encoding apparatus 100 may extract, from the phase-shifted multi-channel signals and using the plurality of parameters, a downmix signal and a residual signal. Here, the downmix signal may include a single-channel signal generated from the multi-channel signals having two or more channels. The generating of the downmix signal from the multi-channel signals having two or more channels may refer to downmixing, and an amount of bits of a bitstream generated in an encoding process may be reduced through the downmixing. A downmix signal may be a signal representing the multi-channel signals. The residual signal may be generated using information being lost during a process of encoding an original source signal into the downmix signal and the plurality of parameters. By encoding the residual signal that may correspond to an error signal generated due to a parametric expression, a high quality audio may be provided using the residual signal at a high bit rate. Operation 330 may be performed by a bitstream generator 140 of the encoding apparatus 100.

In operation 340, the encoding apparatus 100 may generate a bitstream by encoding the downmix signal, the residual signal, and the plurality of parameters. The encoding apparatus 100 may encode and transmit the downmix signal and the residual signal extracted using the plurality of parameters, without encoding each of the multi-channel signals. As an example, in a case where the multi-channel signals are voice signals, the encoding apparatus 100 may generate the bitstream by encoding the downmix signal and the residual signal in a CELP scheme. As another example, in a case where the multi-channel signals are music signals, the encoding apparatus 100 may generate the bitstream by encoding the downmix signal and the residual signal using the existing MPEG-2/4 AAC scheme, mp3 scheme, and the like. Operation 340 may be performed by a bitstream generator 140 of the encoding apparatus 100. The residual signal may not be transmitted as necessary.

As another embodiment, the encoding scheme may perform both of the phase shift and the extraction of the downmix signal and the residual signal in operation 330, without additionally including the operation 320 of shifting the phase. The encoding scheme according to the another embodiment may include operation 310 of extracting, from multi-channel signals, a plurality of parameters indicating a characteristic relationship between a plurality of channels constituting the multi-channel signals, operation of shifting a phase of the multi-channel signals using a phase angle that is calculated for each of the plurality of parameters and the plurality of channels (not shown), and extracting, from the phase-shifted multi-channel signals, a downmix signal and a residual signal, and operation 340 of generating a bitstream by encoding the downmix signal, the residual signal, and the plurality of parameters.

An encoding apparatus and method for encoding multi-channel signals by shifting a phase of the multi-channel signals are described with reference to FIG. 1 through FIG. 3. Hereinafter, an encoding apparatus and method for encoding multi-channel signals by changing a magnitude of the multi-channel signals will be described with reference to FIG. 4 through FIG. 6.

Figure 4:
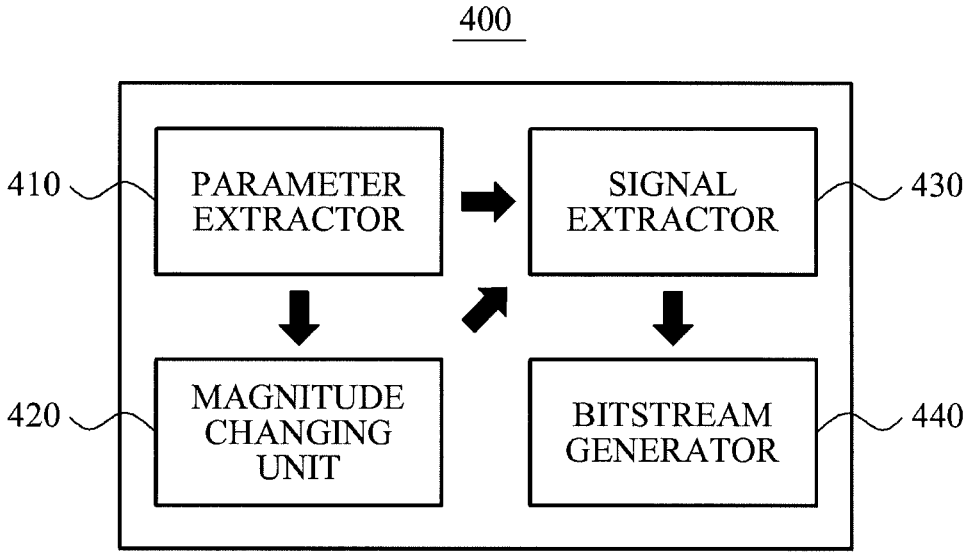
FIG. 4 illustrates a block diagram describing an internal configuration of an encoding apparatus according to other example embodiments.

FIG. 4 illustrates a block diagram describing an internal configuration of an encoding apparatus 400, which may be a computer, according to other example embodiments. Referring to FIG. 4, the encoding apparatus 400 according to other example embodiments may include a parameter extractor 410, a magnitude changing unit 420, a signal extractor 430, and a bitstream generator 440.

Here, the multi-channel signals may refer to signals having a plurality of channels, and each of the plurality of channels included in the multi-channel signals may refer to a channel signal in the present disclosure.

The parameter extractor 410 may extract, from multi-channel signals, a plurality of parameters indicating a characteristic relationship between a plurality of channels constituting the multi-channel signals. Here, the plurality of parameters may include at least two of a channel level differences between the plurality of channels, an inter-channel phase difference between the plurality of channels, and an inter-channel coherence between the plurality of channels.

The magnitude changing unit 420 may change a magnitude of the multi-channel signals, using the plurality of parameters. Here, the magnitude changing unit 420 may change the magnitude of at least one channel signal among the multi-channel signals. A value for changing the magnitude may be determined according to the plurality of extracted parameters. For example, the magnitude changing unit 420 may change the magnitude of the at least one channel signal among the multi-channel signals so that a gain may be within a predetermined maximum value.

The signal extractor 430 may extract, from the magnitude-changed multi-channel signals and using the plurality of parameters, a downmix signal and a residual signal. The downmix signal may include a single-channel signal generated from the multi-channel signals having two or more channels. The generating of the downmix signal from the multi-channel signals having two or more channels may refer to downmixing, and an amount of bits of a bitstream generated in an encoding process may be reduced through the downmixing. A downmix signal may be a signal representing the multi-channel signals. The residual signal may be generated using information being lost during a process of encoding an original source signal into the downmix signal and the plurality of parameters. By encoding the residual signal that may correspond to an error signal generated due to a parametric expression, a high quality audio may be provided using the residual signal at a high bit rate.

The bitstream generator 440 may generate the bitstream by encoding the downmix signal, the residual signal, and the plurality of parameters. The encoding apparatus 400 may encode and transmit the downmix signal and the residual signal extracted using the plurality of parameters, without encoding each of the multi-channel signals. As an example, in a case where the multi-channel signals are voice signals, the bitstream generator 440 may generate the bitstream by encoding the downmix signal and the residual signal in a CELP scheme. As another example, in a case where the multi-channel signals are music signals, the bitstream generator 440 may generate the bitstream by encoding the downmix signal and the residual signal using the existing MPEG-2/4 AAC scheme, mp3 scheme, and the like. The residual signal may optionally not be transmitted.

As another embodiment, the encoding apparatus 400 may perform both of the phase shift and the extraction of the downmix signal and the residual signal in the signal extractor 430, without additionally including the magnitude changing unit 420. The encoding apparatus 400 according to the another embodiment may include the parameter extractor 410 to extract, from multi-channel signals, a plurality of parameters indicating a spatial characteristic relationship between a plurality of channels constituting the multi-channel signals, the signal extractor 430 to change a magnitude of the multi-channel signals using the plurality of parameters, and to extract, from the magnitude-changed multi-channel signals, a downmix signal and a residual signal, and the bitstream generator 440 to generate a bitstream by encoding the downmix signal, the residual signal, and the plurality of parameters.

Figure 5:
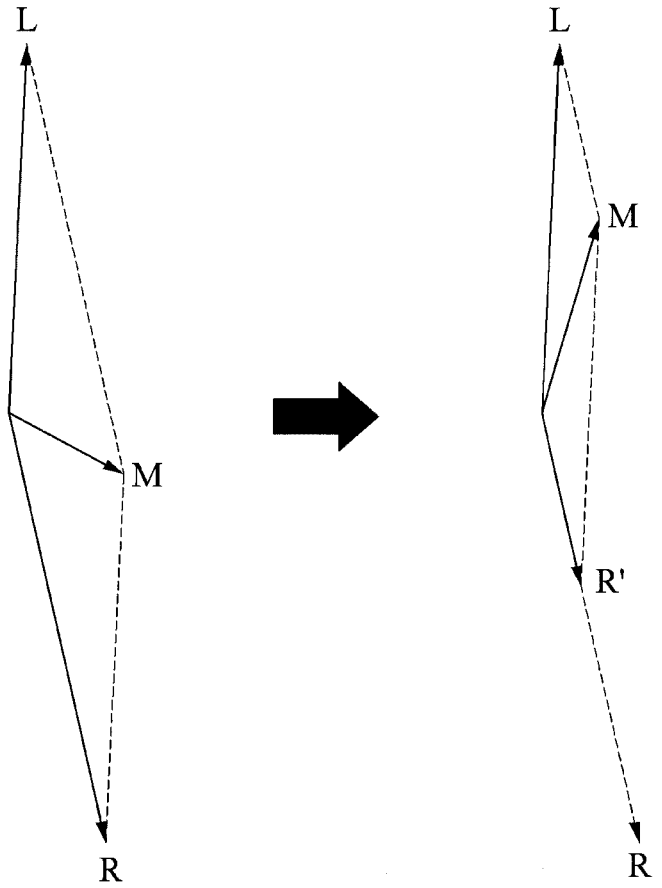
FIG. 5 illustrates a diagram describing a magnitude change in multi-channel signals as stereo signals according to example embodiments.

FIG. 5 illustrates a diagram describing a magnitude change in multi-channel signals as stereo signals according to example embodiments.

In FIG. 5, for convenience of description, it is assumed that multi-channel signals inputted in an encoding apparatus 400 correspond to stereo signals including a left channel signal and a right channel signal.

Referring to FIG. 5, a relationship among a left channel signal L, a right channel signal R, and a downmix signal M is described. When the stereo signals are downmixed or upmixed, in a case where the left channel signal L and the right channel signal R are out-of-phase or near out-of-phase, a magnitude of L+R may decrease, and may become near "0" on occasion. To compensate for an energy loss due to the decrease, a magnitude of the downmix signal M may be generally set by multiplying a sum of the L and the R by a gain calculated to reflect a sum of energies of the L and the R. The gain may increase while becoming out-of-phase or near out-of-phase, a divergence may occur according to a relationship between a plurality of extracted parameters, and a magnitude of the residual signal may increase since the obtained gain may be multiplied by the residual signal S. Accordingly, the gain may be limited. Since the limiting of gain may influence not only the downmix signal M, but also the residual signal S, the encoding apparatus 400 according to embodiments may change a magnitude of the stereo signal so that a gain value may be within a predetermined maximum value. A graph on the left side of FIG. 5 illustrates that the left channel signal L and the right channel signal R are becoming out-of-phase, and a graph on the right side of FIG. 5 illustrates that a magnitude of the right channel signal R is changed so that the gain may be within the predetermined maximum value. Referring to FIG. 5, when the downmix or upmix is performed using the magnitude-changed right channel signal R' and the left channel signal L, the gain divergence may be prevented. By preventing the gain divergence, a change in a value of the residual signal S according to the gain divergence may not occur, and a loss generated in the downmix may be compensated for.

Figure 6:
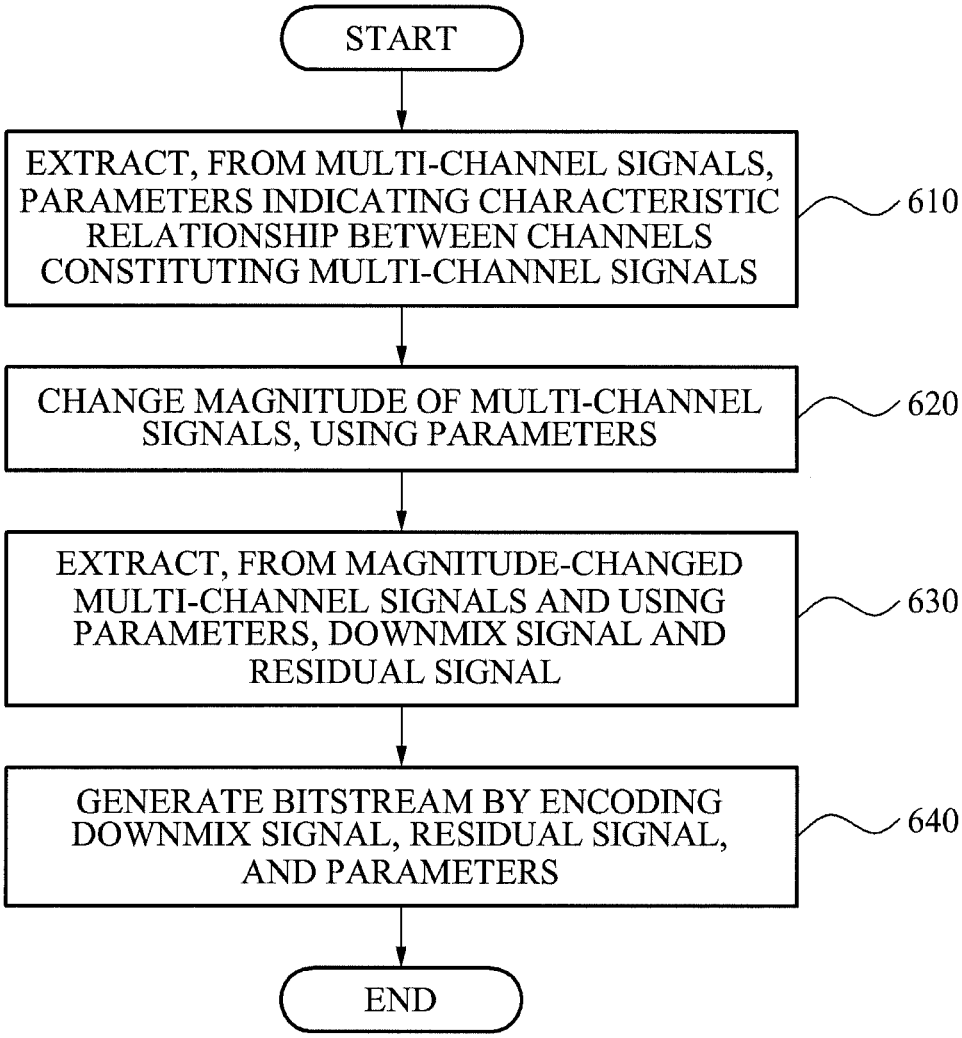
FIG. 6 illustrates a flowchart describing a scheme for encoding multi-channel signals according to other example embodiments.

FIG. 6 illustrates a flowchart describing a scheme for encoding multi-channel signals according to other example embodiments. The encoding scheme according to embodiments may be performed by an encoding apparatus 400 described with reference to FIG. 4. In FIG. 6, the encoding scheme may be described by describing each operation performed by the encoding apparatus 400.

In operation 610, the encoding apparatus 400 may extract, from multi-channel signals, a plurality of parameters indicating a characteristic relationship between a plurality of channels constituting the multi-channel signals. Here, the plurality of parameters include at least two of a channel level differences between the plurality of channels, an inter-channel phase difference between the plurality of channels, and an inter-channel coherence between the plurality of channels. Operation 610 may be performed by a parameter extracting unit 410 of the encoding apparatus 400.

In operation 620, the encoding apparatus 400 may change a magnitude of the multi-channel signals, using the plurality of parameters. Here, the encoding apparatus 400 may change the magnitude of at least one channel signal among the multi-channel signals. A value for changing the magnitude may be determined according to the plurality of extracted parameters. For example, the encoding apparatus 400 may change the magnitude of the at least one channel signal among the multi-channel signals so that a gain may be within a predetermined maximum value. Operation 620 may be performed by a magnitude changing unit 420 of the encoding apparatus 400.

In operation 630, the encoding apparatus 400 may extract, from the magnitude-changed multi-channel signals and using the plurality of parameters, a downmix signal and a residual signal. Here, the downmix signal may include a single-channel signal generated from the multi-channel signals having two or more channels. The generating of the downmix signal from the multi-channel signals having two or more channels may refer to downmixing, and an amount of bits of a bitstream generated in an encoding process may be reduced through the downmixing. A downmix signal may be a signal representing the multi-channel signals. The residual signal may be generated using information being lost during a process of encoding original source signal to the downmix signal and the plurality of parameters. By encoding the residual signal that may correspond to an error signal generated due to a parametric expression, a high quality audio may be provided using the residual signal at a high bit rate. Operation 630 may be performed by a signal extractor 430 of the encoding apparatus 400.

In operation 640, the encoding apparatus 400 may generate a bitstream by encoding the downmix signal, the residual signal, and the plurality of parameters. The encoding apparatus 400 may encode and transmit the downmix signal and the residual signal extracted using the plurality of parameters, without encoding each of the multi-channel signals. As an example, in a case where the multi-channel signals are voice signals, the encoding apparatus 400 may generate the bitstream by encoding the downmix signal and the residual signal in a CELP scheme. As another example, in a case where the multi-channel signals are music signals, the encoding apparatus 400 may generate the bitstream by encoding the downmix signal and the residual signal using the existing MPEG-2/4 AAC scheme, mp3 scheme, and the like. Operation 640 may be performed by a bitstream generator 440 of the encoding apparatus 400. The residual signal may not be transmitted as necessary.

As another embodiment, the encoding scheme may perform both of the magnitude change and the extraction of the downmix signal and the residual signal in operation 630, without additionally including the operation 620 of changing the magnitude. The encoding scheme according to the another embodiment may include operation 610 of extracting, from multi-channel signals, a plurality of parameters indicating a characteristic relationship between a plurality of channels constituting the multi-channel signals, operation of changing the magnitude of the multi-channel signals using the plurality of parameters (not shown), and extracting, from the magnitude-changed multi-channel signals, a downmix signal and a residual signal, and operation 640 of generating a bitstream by encoding the downmix signal, the residual signal, and the plurality of parameters.

Figure 7:
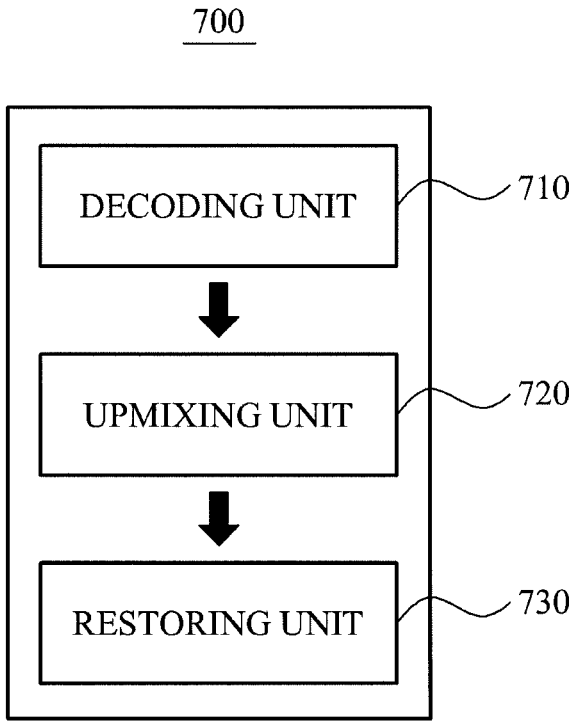
FIG. 7 illustrates a block diagram describing an internal configuration of a decoding apparatus according to example embodiments.

FIG. 7 illustrates a block diagram describing an internal configuration of a decoding apparatus 700, which may be a computer, according to example embodiments. Referring to FIG. 7, the decoding apparatus 700 according to embodiments may include a decoding unit 710, an upmixing unit 720, and a restoring unit 730.

The decoding unit 710 may restore a downmix signal and a residual signal of multi-channel signals, and a plurality of parameters indicating a characteristic relationship between a plurality of channels constituting the multi-channel signals. The multi-channel signals may correspond to the multi-channel signals described with reference to FIG. 1 through FIG. 6. For example, a bitstream generated by encoding the multi-channel signals in an encoding apparatus 100 or 400 may be received by the decoding unit 710, and the downmix signal and the residual signal of multi-channel signals, and the plurality of parameters may be decoded to be restored from the received bitstream.

The upmixing unit 720 may upmix the downmix signal and the residual signal into the multi-channel signals, using the restored parameters. Here, the upmixing may refer to generating, using the downmix signal and the residual signal that are single-channel signals, the multi-channel signals having two or more channels, and may correspond to the downmixing for extracting the downmix signal and the residual signal.

The restoring unit 730 may restore at least one of a phase and a magnitude of the multi-channel signals upmixed using the restored parameters. The restoring unit 730 may restore the phase with respect to the multi-channel signals encoded using a phase shift described with reference to FIG. 1 through FIG. 3, and may restore the magnitude with respect to the multi-channel signals encoded using a magnitude change described with reference to FIG. 4 though FIG. 6. Hereinafter, a decoding scheme will be further described.

Figure 8:
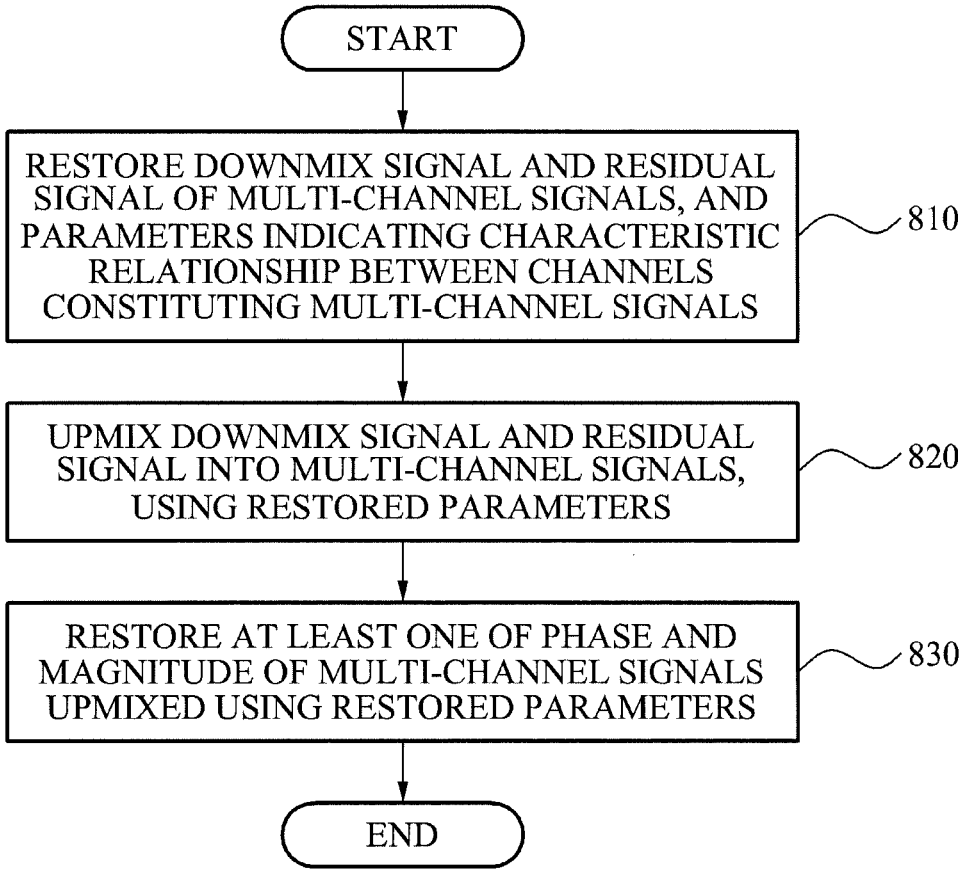
FIG. 8 illustrates a flowchart describing a decoding scheme according to example embodiments.

FIG. 8 illustrates a flowchart describing a decoding scheme according to example embodiments. The decoding scheme according to example embodiments may be performed by a decoding apparatus 700 described with reference to FIG. 7. In FIG. 8, the decoding scheme may be described by describing each operation performed by the decoding apparatus 700.

In operation 810, the decoding apparatus 700 may restore a downmix signal and a residual signal of multi-channel signals, and a plurality of parameters indicating a characteristic relationship between a plurality of channels constituting the multi-channel signals. Here, the multi-channel signals may correspond to the multi-channel signals described with reference to FIG. 1 through FIG. 6. For example, a bitstream generated by encoding the multi-channel signals in an encoding apparatus 100 or 400 may be received by the decoding apparatus 700, and the downmix signal and the residual signal of multi-channel signals, and the plurality of parameters may be decoded to be restored from the received bitstream. Operation 810 may be performed by a decoding unit 710 of the decoding apparatus 700.

In operation 820, the decoding apparatus 700 may upmix, using the restored parameters, the downmix signal and the residual signal into the multi-channel signals. Here, the upmixing may refer to generating, using the downmix signal and the residual signal that are single-channel signals, the multi-channel signals having two or more channels, and may correspond to the downmixing for extracting the downmix signal and the residual signal. Operation 820 may be performed by an upmixing unit 720 of the decoding apparatus 700.

In operation 830, the decoding apparatus 700 may restore at least one of a phase and a magnitude of the multi-channel signals upmixed using the restored parameters. The restoring unit 730 may restore the phase with respect to the multi-channel signals encoded using a phase shift described with reference to FIG. 1 through FIG. 3, and may restore the magnitude with respect to the multi-channel signals encoded using a magnitude change described with reference to FIG. 4 though FIG. 6. Operation 830 may be performed by the restoring unit 730 of the decoding apparatus 700, and the decoding scheme will be further described.

Equation 1 below may indicate an example of matrix $R_2^{l,m}$ that may be used for upmixing the multi-channel signals in the encoding apparatus and scheme. For example, the upmixing may be performed by a matrix calculation between a matrix having, as elements, a value of the downmix signal and a value of the residual signal and matrix $R_2^{l,m}$.

$$R_2^{l,m} = \begin{bmatrix} H11_{OTT}^{l,m} & H12_{OTT}^{l,m} \\ H21_{OTT}^{l,m} & H22_{OTT}^{l,m} \end{bmatrix} = \begin{cases} \frac{1}{2c^{l,m}} \begin{bmatrix} e^{j\theta_1} & 0 \\ 0 & e^{j\theta_2} \end{bmatrix} \begin{bmatrix} 1-\alpha^{l,m} & \beta^{l,m} \\ 1+\alpha^{l,m} & -\beta^{l,m} \end{bmatrix}, & m < resBands \\ \frac{1}{2c^{l,m}} \begin{bmatrix} e^{j\theta_1} & 0 \\ 0 & e^{j\theta_2} \end{bmatrix} \begin{bmatrix} 1-\alpha^{l,m} & \beta^{l,m} \\ 1+\alpha^{l,m} & -\beta^{l,m} \end{bmatrix}, & \text{otherwise} \end{cases} \quad \text{[Equation 1]}$$

In Equation 1, 'resBands' may refer to bands of the residual signal, and $\alpha^{l,m}$, $\beta^{l,m}$ and $c^{l,m}$ may be expressed by the following Equation 2 through Equation 4.

$$\alpha^{l,m} = -\frac{CLD_{lin}^{l,m} - 1 + j2\sqrt{CLD_{lin}^{l,m}} \cdot ICC^{l,m} \cdot \sin(IPD^{l,m} - (\theta_1 - \theta_2))}{CLD_{lin}^{l,m} + 1 + 2\sqrt{CLD_{lin}^{l,m}} \cdot ICC^{l,m} \cdot \cos(IPD^{l,m} - (\theta_1 - \theta_2))} \quad \text{[Equation 2]}$$

$$\beta^{l,m} = \frac{2 \cdot \sqrt{CLD_{lin}^{l,m} \cdot (1 - (ICC^{l,m})^2)}}{CLD_{lin}^{l,m} + 1 + 2\sqrt{CLD_{lin}^{l,m}} \cdot ICC^{l,m} \cdot \cos(IPD^{l,m} - (\theta_1 - \theta_2))} \quad \text{[Equaton 3]}$$

$$c^{l,m} = \sqrt{\frac{CLD_{lin}^{l,m} + 1}{CLD_{lin}^{l,m} + 1 + 2\sqrt{CLD_{lin}^{l,m}} \cdot ICC^{l,m} \cdot \cos(IPD^{l,m} - (\theta_1 - \theta_2))}} \quad \text{[Equation 4]}$$

Equation 5 below may indicate an example of matrix $D_2^{l,m}$ that may be used for downmixing the multi-channel signals in the encoding apparatus and scheme. For example, the downmixing may be performed by a matrix calculation between a matrix having, as elements, a value of the left channel signal and a value of the right channel signal and matrix $R_2^{l,m}$.

$$D_2^{l,m} = \begin{cases} c^{l,m} \begin{bmatrix} 1 & 1 \\ 1+\alpha^{l,m} & -1+\alpha^{l,m} \end{bmatrix} \begin{bmatrix} e^{-j\theta_1} & 0 \\ 0 & e^{-j\theta_2} \end{bmatrix}, & m < resBands \\ c^{l,m}[\, e^{-j\theta_1} \quad e^{-j\theta_2} \,], & \text{otherwise} \end{cases} \quad \text{[Equation 5]}$$

Here, in the above Equations, the phase of the multi-channel signals may be shifted using $\theta_1$ and $\theta_2$. $\theta_1$ and $\theta_2$ may correspond to phase angles of each channel described with reference to FIG. 1 and FIG. 3. The limiting of gain may be minimized by setting $\theta_1$ and $\theta_2$ so that the denomination value of $\alpha^{l,m}$, $\beta^{l,m}$ and $c^{l,m}$ may be greater than an predetermined value E as given by Equation 6.

$$|\sqrt{CLD_{lin}^{l,m}} + 1 + 2 \cdot ICC^{l,m} \cdot \cos(IPD^{l,m} - (\theta_1 - \theta_2))| > \epsilon \quad \text{[Equation 6]}$$

As described above, the encoding apparatus according to embodiments may shift the phase of the multi-channel signals so that each multi-channel signal may have the same phase. For example, when a value of $\theta_1 - \theta_2$ is equal to a value of $IPD^{l,m}$, a complete phase aligning may be performed to prevent the gain divergence.

As another embodiment, the encoding apparatus may shift the phase of the multi-channel signals by a predetermined amount so that phase difference information between the channels may have a value less than or equal to a value of a predetermined angle. For example, the encoding apparatus may allow a value of $\cos(IPD^{l,m} - (\theta_1 - \theta_2))$ to be greater than or equal to "0" by setting $\theta_1$ and $\theta_2$ to be $\pi/4$ and $-(\pi/4)$, respectively, in a case where a value of $IPD^{l,m}$ is less than or equal to $\pi$, or by setting $\theta_1$ and $\theta_2$ to be $-\pi/4$ and $(\pi/4)$, respectively, in a case where a value of $IPD^{l,m}$ is greater than or equal to $\pi$. In this case, the predetermined angle may be 90 degrees. Values of $\theta_1$ and $\theta_2$ may be predetermined constant values, and may be calculated by the plurality of extracted parameters.

As another embodiment, the encoding apparatus may shift the phase of the multi-channel signals so that a change in the phase angle may be minimized. By minimizing the shifted magnitude of the phase, the upmixing of the encoding apparatus may use the existing scheme, and in a case downmixing in the encoding apparatus, the phase may be shifted.

The encoding apparatus according to another embodiment may change the magnitude of at least one channel signal among the multi-channel signals. Equation 7 shown below may indicate an example of a matrix used for the downmixing in the encoding apparatus according to another apparatus, and Equation 8 may indicate an example of a matrix used for the upmixing in the encoding apparatus according to another apparatus.

$$\begin{bmatrix} M \\ S \end{bmatrix} = c^{l,m} \begin{bmatrix} 1 & A \\ 1+\alpha & (-1+\alpha)A \end{bmatrix} \begin{bmatrix} L \\ R \end{bmatrix} \quad \text{[Equation 7]}$$

$$\begin{bmatrix} L \\ R \end{bmatrix} = \frac{1}{2c^{l,m}} \begin{bmatrix} 1-\alpha & 1 \\ (1+\alpha)A^{-1} & -A^{-1} \end{bmatrix} \begin{bmatrix} M \\ S \end{bmatrix} \quad \text{[Equation 8]}$$

Here, L and R may indicate a value of the left channel signal and a value of the right channel signal, respectively, in a case where the multi-channel signals are stereo signals, M may indicate a value of the downmix signal, and S may indicate a value of the residual signal. 'A' may be express by the following Equation 9.

$$A = -\cos(IPD^{l,m}) ICC^{l,m} \sqrt{CLD_{lin}^{l,m}} \pm \sqrt{\left(\cos(IPD) ICC \sqrt{CLD_{lin}^{l,m}}\right)^2 - (CLD_{lin}^{l,m}((c^{l,m})^2 - 1) - 1)/(c^{l,m})^2} \quad \text{[Equation 9]}$$

According to Equation 7, by changing a magnitude of a value of the right channel signal based on 'A', the gain value may be controlled to be within a predetermined maximum value.

The above Equation 1 through Equation 9 are merely examples, and a scheme of calculating $\alpha^{l,m}$, $\beta^{l,m}$, a scheme of determining $\theta_1$ and $\theta_2$, and the like may be variously changed based on a magnitude or phase parameter, for example, an IPD. For example, an OPD estimation may be used, or a value may be set based on an IPD, a CLD, and a ICC, and it may be simplified by setting to $\theta_1=-\theta_2$.

As described above, according to embodiments, by shifting the phase or changing the magnitude of the multi-channel signals, the gain divergence may be prevented, a change in a value of the residual signal according to the gain divergence may not occur, and a loss generated in the downmix may be compensated for.

The encoding and decoding methods according to the above-described embodiments may be recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa.

Although embodiments have been shown and described, it would be appreciated by those skilled in the art that changes may be made in these embodiments without departing from the principles and spirit of the disclosure, the scope of which is defined by the claims and their equivalents.

What is claimed is:

1. An encoding apparatus, comprising:

a parameter extractor to extract, from multi-channel signals, a plurality of parameters indicating a relationship between a plurality of channels constituting the multi-channel signals;

a phase shifter to shift a phase of the multi-channel signals to produce a phase-shifted multi-channel signal using a phase angle that is calculated for each of the plurality of parameters and the plurality of channels;

a signal extractor to extract, from the phase-shifted multi-channel signals and using the plurality of parameters, a downmix signal and a residual signal; and a bitstream generator to generate a bitstream by encoding the downmix signal, the residual signal, and the plurality of parameters.

2. The encoding apparatus of claim 1, wherein the phase shifter shifts the phase of the multi-channel signals so that each multi-channel signal has a same phase.

3. The encoding apparatus of claim 1, wherein the phase shifter shifts the phase of the multi-channel signals by a predetermined amount so that phase difference information between the channels have a value less than or equal to a value of a predetermined angle.

4. The encoding apparatus of claim 1, wherein the phase shifter shifts the phase of the multi-channel signals so that a change in the phase angle is minimized.

5. The encoding apparatus of claim 1, wherein the plurality of parameters include at least two of a channel level differences (CLD) between the plurality of channels, an inter-channel phase difference (IPD) between the plurality of channels, and an inter-channel coherence (ICC) between the plurality of channels.

6. A decoding apparatus, comprising:

a decoding unit to restore a downmix signal and a residual signal of multi-channel signals, and a plurality of parameters indicating a relationship between a plurality of channels constituting the multi-channel signals to produce a restored down mix signal, a restored residual signal and restored parameters;

an upmixing unit to upmix the restored downmix signal and the restored residual signal into the multi-channel signals, using the restored parameters; and a restoring unit to restore at least one of a phase and a magnitude of the multi-channel signals upmixed using the restored parameters.

7. An encoding apparatus, comprising:

a parameter extractor to extract, from multi-channel signals, a plurality of parameters indicating a relationship between a plurality of channels constituting the multi-channel signals;

a signal extractor to shift a phase of the multi-channel signals using a phase angle that is calculated for each of the plurality of parameters and a plurality of channels to produce phase-shifted multi-channel signals, and to extract, from the phase-shifted multi-channel signals, a downmix signal and a residual signal; and a bitstream generator to generate a bitstream by encoding the downmix signal, the residual signal, and the plurality of parameters.

8. An encoding method for encoding multi-channel signals in an encoding apparatus, the method comprising:

extracting, by a parameter extractor of the encoding apparatus, from multi-channel signals, a plurality of parameters indicating a relationship between a plurality of channels constituting the multi-channel signals;

shifting, by a phase shifter of the encoding apparatus, a phase of the multi-channel signals, using a phase angle that is calculated for each of the plurality of parameters and the plurality of channels to produce phase-shifted multi-channel signals;

extracting, by a signal extractor of the encoding apparatus, from the phase-shifted multi-channel signals and using the plurality of parameters, a downmix signal and a residual signal; and generating, by a bitstream generator of the encoding apparatus, a bitstream by encoding the downmix signal, the residual signal, and the plurality of parameters.

9. A non-transitory computer-readable medium comprising a program for instructing a computer to perform the method of claim 8.

10. An encoding method, comprising:

extracting, from multi-channel signals, a plurality of parameters indicating a relationship between a plurality of channels constituting the multi-channel signals;

shifting a phase of the multi-channel signals, using a phase angle that is calculated for each of the plurality of parameters and the plurality of channels to produce phase-shifted multi-channel signals, and extracting, from the phase-shifted multi-channel signals, a downmix signal and a residual signal; and generating a bitstream by encoding the downmix signal, the residual signal, and the plurality of parameters.

11. A decoding method for decoding multi-channel signals in a decoding apparatus, the method comprising:

restoring, by a decoding unit of the decoding apparatus, a downmix signal and a residual signal of multi-channel signals, and a plurality of parameters indicating a relationship between a plurality of channels constituting the multi-channel signals to produce a restored down mix signal, a restored residual signal and restored parameters;

upmixing, by an upmixing unit of the decoding apparatus, the restored downmix signal and the restored residual signal into the multi-channel signals, using the restored parameters; and restoring, by a restoring unit of the decoding apparatus, at least one of a phase and a magnitude of the multi-channel signals upmixed using the restored parameters.

* * * * *

UNITED STATES PATENT AND TRADEMARK OFFICE

CERTIFICATE OF CORRECTION

PATENT NO. : 8,824,577 B2
APPLICATION NO. : 13/088720
DATED : September 2, 2014
INVENTOR(S) : Shim Hwan et al.

It is certified that error appears in the above-identified patent and that said Letters Patent is hereby corrected as shown below:

In the Claims

Column 14, Line 15, In Claim 6, delete “down mix” and insert -- downmix --, therefor.

Column 15, Line 9, In Claim 11, delete “down mix” and insert -- downmix --, therefor.

Signed and Sealed this
Eighteenth Day of November, 2014

Michelle K. Lee

Michelle K. Lee
*Deputy Director of the United States Patent and Trademark Office*